US005318124A

United States Patent [19]

Ong et al.

[11] Patent Number: 5,318,124

[45] Date of Patent: Jun. 7, 1994

[54] RECOVERING HYDROCARBONS FROM TAR SAND OR HEAVY OIL RESERVOIRS

[75] Inventors: Tee S. Ong; Ronald A. Hamm, both of Calgary, Canada

[73] Assignees: Pecten International Company, Houston, Tex.; Shell Canada Limited, Calgary, Canada

[21] Appl. No.: 974,439

[22] Filed: Nov. 12, 1992

[30] Foreign Application Priority Data

Nov. 14, 1991 [CA] Canada ..... 2055549

[51] Int. Cl.[5] ..... E21B 43/24

[52] U.S. Cl. ..... 166/263; 166/50; 166/272

[58] Field of Search ..... 166/50, 52, 245, 263, 166/272

[56] References Cited

U.S. PATENT DOCUMENTS

| | | | |
|---|---|---|---|
| 3,749,170 | 7/1973 | Riehl | 166/272 |
| 3,847,219 | 11/1974 | Wang et al. | 166/272 X |
| 3,848,671 | 11/1974 | Kern | 166/248 |
| 3,958,636 | 5/1976 | Perkins | 166/248 |
| 4,456,065 | 6/1984 | Heim et al. | 166/248 |
| 4,545,435 | 10/1985 | Bridges et al. | 166/248 |
| 4,598,770 | 7/1986 | Shu et al. | 166/50 X |
| 4,850,429 | 7/1989 | Mims et al. | 166/245 |
| 4,926,941 | 5/1990 | Glandt et al. | 166/248 |
| 5,016,709 | 5/1991 | Combe et al. | 166/52 X |
| 5,042,579 | 8/1991 | Glandt et al. | 166/248 |
| 5,127,457 | 7/1992 | Stewart et al. | 166/50 X |

*Primary Examiner*—George A. Suchfield

[57] ABSTRACT

Method of recovering fluids from an underground tar sand reservoir or heavy oil reservoir comprising (a) drilling and completing a first pair of wells and a second pair of wells, each pair comprising an injection well terminating in the reservoir and a production well terminating in the reservoir below the injection well; (b) circulating steam through the injection wells and performing alternate steam injection and fluid production through the production wells; and (c) injecting steam through the injection wells while producing fluids through the production wells, wherein the injection pressure of the injection well of the first pair of wells is greater than the injection pressure of the injection well of the second pair of wells.

10 Claims, 2 Drawing Sheets

RECOVERING HYDROCARBONS FROM TAR SAND OR HEAVY OIL RESERVOIRS

FIELD OF THE INVENTION

The present invention relates to recovering hydrocarbons from an underground tar sand reservoir or from a heavy oil reservoir. Such a reservoir contains oil that is so viscous that the reservoir may be initially impermeable. In order to produce hydrocarbons from such a reservoir the viscosity of the oil has to be reduced, this can be done by heating the reservoir.

BACKGROUND OF THE INVENTION

A method of recovering hydrocarbon liquid and gas fluids from an underground tar sand or heavy oil reservoir is known which comprises (a) drilling and completing a pair of wells, which pair comprises an injection well terminating in the reservoir and a production well terminating in the reservoir below the injection well; and (b) creating a permeable zone between the injection well and the production well.

After having created permeable zones between the injection well and the production well steam injection through the production well is stopped and steam is only injected through the injection well while fluids are produced through the production well.

It is believed that the injected steam forms in the reservoir a steam-containing, heated zone around and above the injection well and that fluids (throughout) are mobilized in the heated reservoir and drain by gravity through the heated zone to the production well which is located below the injection well. Therefore this method is referred to as steam assisted gravity drainage.

It is an object of the present invention to improve the known method.

SUMMARY OF THE INVENTION

This and other objects are accomplished by a method of recovering fluids from an underground tar sand reservoir or heavy oil reservoir comprising (a) drilling and completing at least two pairs of wells, wherein each pair of wells comprises an injection well terminating in the reservoir and a production well terminating in the reservoir below the injection well; (b) creating for each pair of wells a permeable zone between the injection well and the production well; and (c) injecting steam through the injection wells while producing fluids through the production wells, wherein the injection pressure of the injection well of the first pair of wells is greater than the injection pressure of the injection well of the second pair of wells.

The two pairs of wells preferably face each other within the formation, and are separated from each other by a pre-determined distance.

The effect of injecting steam at different pressures is that the steam-containing zone of the injection well pertaining to the first pair of wells grows further into the reservoir away from the injection well towards the injection well of the second pair of wells. The growth of the steam-containing zone of the first well pair towards the steam-containing zone of the second well pair can only occur after such time as the hydrocarbon contained between the two steam-containing zones becomes mobile. At such time as the minimum hydrocarbon mobility is achieved between the two steam-containing zones, the application of a small pressure differential between the two steam-containing zone results in a mild steam drive, causing the accelerated growth of the steam-containing zone of the first well pair towards the steam-containing zone of the second well pair, and resulting in accelerated production of hydrocarbons from the producers of both well pairs. This mild steam drive enhances the overall production performance of the steam assisted gravity drainage process.

DETAILED DESCRIPTION OF THE DRAWINGS

Figure 1:
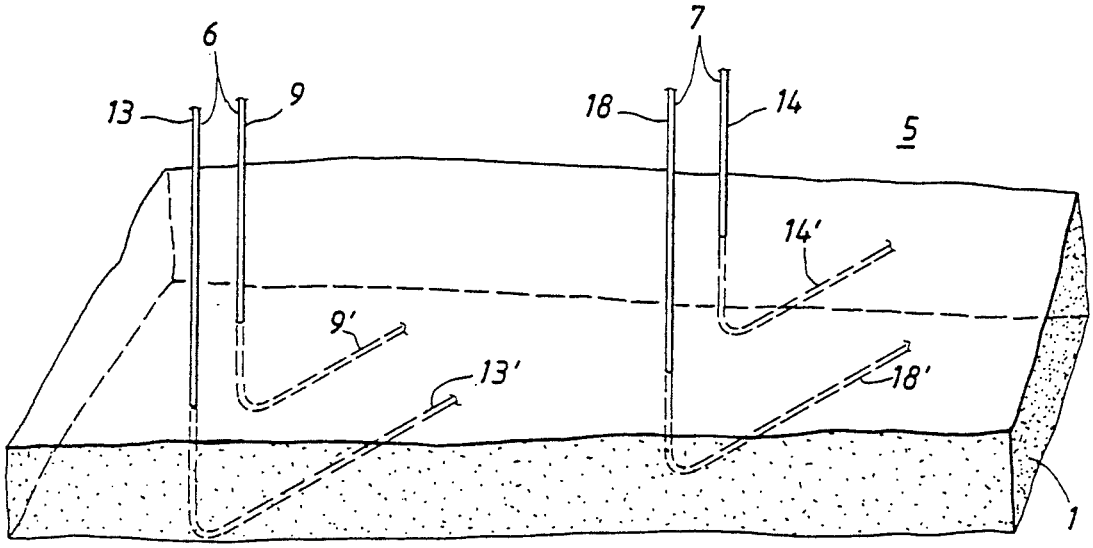
FIG. 1 shows schematically a perspective view of the underground tar sand reservoir with two pairs of wells.

Referring now to FIG. 1, an underground tar sand reservoir 1 is shown which reservoir is located below a covering formation layer 5 which formation layer extends to surface (not shown). From the surface to the reservoir two pairs of wells have been drilled, a first pair 6 comprising wells 9 and 13 and a second pair 7 comprising wells 14 and 18. Each pair 6 and 7 of wells comprises an injection well 9 and 14, respectively, which injection wells terminate in the reservoir, and each pair 6 and 7 of wells comprises a production well 13 and 18, respectively, which production wells 13 and 18 terminate in the reservoir below the injection well 9 and 14. The second pair 7 of wells faces the first pair 6 of wells.

Each well has a horizontal end part that is located in the underground tar sand reservoir 1, the horizontal end parts are referred to with reference numerals 9', 13', 14' and 18'. Dashed line segments have been used to show the part of the well that is below the top of the tar sand reservoir 1. Each of the wells 9, 13, 14 and 18 has been completed with a casing or a liner (not shown) which extend to total depth and which is open to the tar sand reservoir 1 via perforations or other means in the horizontal end part 9', 13', 14' and 18', respectively. Furthermore each of the wells 9, 13, 14 and 18 has been provided with a tubing (not shown) extending into the horizontal end part 9', 13', 14' and 18', respectively.

During normal operation for each pair of wells a permeable zone between the injection well 9 or 14 and the production well 13 or 18, respectively, is created in the initially impermeable tar sand reservoir 5. Creating the permeable zones is accomplished by circulating steam through the injection wells 9 and 14 and performing alternate steam injection and fluid production through the production wells 13 and 18. Circulating steam through a well is done by injecting steam through the tubing arranged in the well and producing fluids through the annulus between the tubing and the well casing, or by injecting steam through the annulus and producing fluids through the tubing. The alternate steam injection and fluid production through the production wells 13 and 18 occurs according to a steam soak method or a huff and puff method. Alternate steam injection and fluid production through the production well 13 can be accomplished in phase with alternate steam injection and fluid production through the production well 18, or it can be done out of phase so that when injection is carried out through production well 13, fluid are produced through well 18 followed by the reverse.

When a permeable path has been created between the injection wells and the production wells, steam injection through the production wells 13 and 18 is stopped and steam assisted gravity drainage according to the present invention is started. To this end steam is injected through the injection wells 9 and 14 while producing fluid through the production wells 13 and 18, wherein the injection pressure of the injection well 9 of the first pair 6 of wells is greater than the injection pressure of the injection well 14 of the second pair of wells 7.

Figure 2:
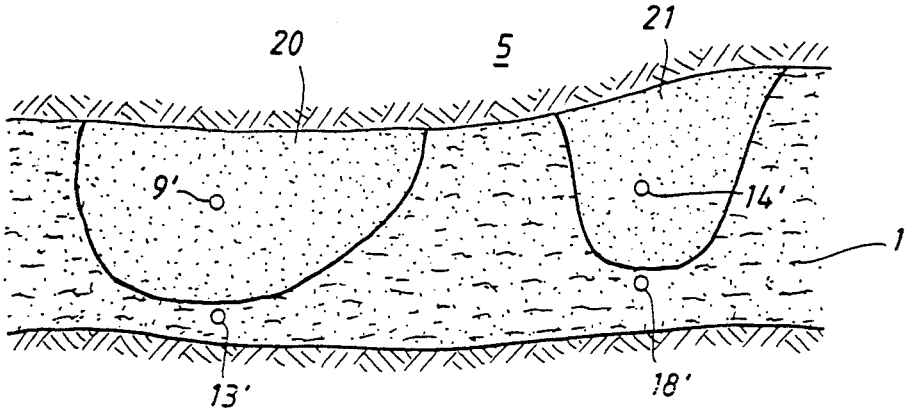
FIG. 2 shows schematically a vertical cross-section of the underground tar sand reservoir of FIG. 1.

Referring now to FIG. 2, during the steam assisted gravity drainage according to the present invention steam enters the formation through the horizontal parts 9' and 14' of the injection wells, and steam-containing zones 20 and 21 are formed. When sufficient mobility of the hydrocarbon contained between the two steam-containing zones 20 and 21 is achieved by heat conduction from steam-containing zones 20 and 21 or other means, the difference in injection pressure will cause the steam containing zone 20 to expand and become larger than the steam containing zone 21. In this way a larger part of the reservoir is heated than in the conventional method. Therefore in the method according to the present invention a larger steam-containing zone is created which results in a larger recovery rate and a higher recovery efficiency. The improvements are shown in the following hypothetical example.

A numerical simulation study has been carried out to compare the present method with a base case. The reservoir conditions are those of the Peace River tar sand reservoir in Alberta, Canada. In the tar sand reservoir having a formation thickness of 26 m at a depth of about 570 m two pairs of wells are arranged, the length of the horizontal wells is 790 m. The horizontal parts of the production wells are about 10 m below the horizontal parts of the injection wells. The horizontal spacing between the two pairs of wells is 64 m.

The path is prepared as follows. At first steam is circulated in the injection wells at 260° C. to heat the formation surrounding the injection wells 9 and 14 and heated fluids are produced to reduce the pressure increase in the reservoir. This continues for one year. During this period production well 13 undergoes alternate periods of steam injection and production. Thereafter steam having a steam quality of 90% (this is steam containing 10% by mass of water in the liquid phase) is injected through production well 13 and fluids are produced through production well 18 for 60 days. Thereafter the reverse is done for 60 days. This 120 days injection and production cycle is repeated twice.

Thereafter steam assisted gravity drainage is started. For the base case steam is injected through the injection wells 9 and 14 with injection pressures of 4000 kPa and fluids are recovered through the production wells 13 and 18. At the end of a ten year period the recovery efficiency was 0.62, wherein the recovery efficiency is the amount of recovered tar divided by the amount of tar originally in place. The cumulative oil production is 184,000 $m^3$.

Steam assisted gravity drainage according to the present invention is done after the path is prepared as described above by injecting steam through the injection well 9 at a pressure of 4000 kPa and through the injection well 14 at a lower pressure of 3500 kPa. At the end of a ten year period the recovery efficiency is 0.90 and the cumulative oil production is 267,000 $m^3$.

The difference in injection pressure between adjacent injection wells is suitably between 50 and 2000 kPa.

Figure 3:
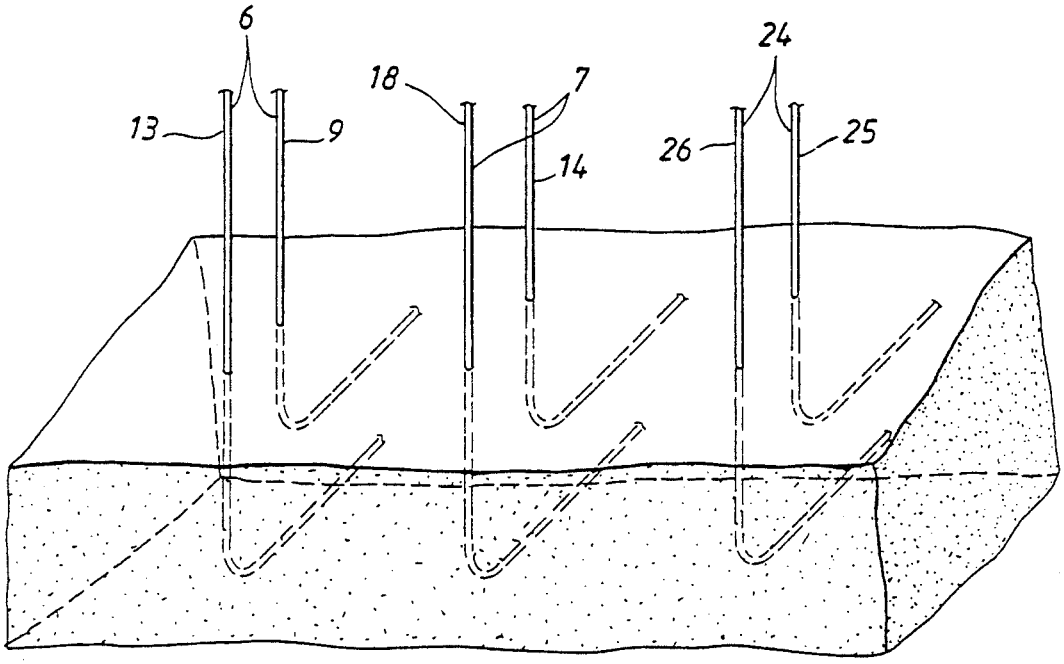
FIG. 3 shows schematically a perspective view of the underground tar sand reservoir with three pairs of wells.

In the method discussed with reference of FIGS. 1 and 2 only two pairs of wells were used. It will be appreciated that a further pair of wells can be used as well as shown in FIG. 3, the wells of this further pair 24 are referred to with reference numerals 25 and 26. The injection well is well 25 and the production well is well 26. The further pair 24 of wells faces the second pair 7 of wells.

The further pair 24 of wells is a first pair of wells with respect to the second pair 7 of wells. So that during normal operation after establishing a permeable zone between the injection wells 9, 14 and 25 and the production wells 13, 18 and 26 as described above the steam injection pressures in the injection wells is so selected that the injection pressure in the injection wells 9 and 25 is greater than the injection pressure in the injection well 14.

A next pair of wells (not shown) can be used as well right of the further pair 24 of wells which is a second pair of wells with respect to the further pair 24 of wells. When more pairs of wells are used the designations first and second pair of wells follows the above trend.

Figure 4:
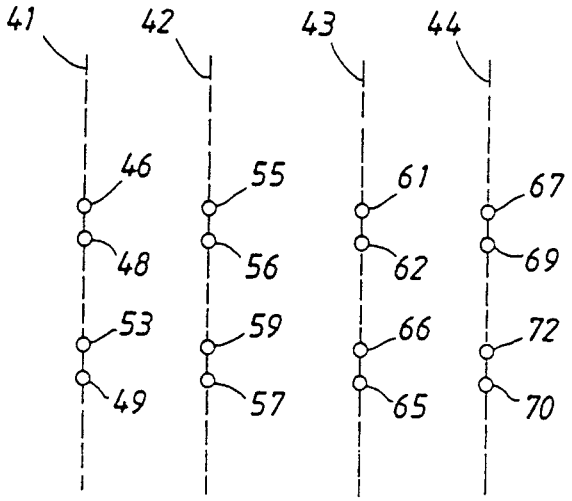
FIG. 4 showing a plan of the surface locations of four rows of wells.

Reference is now made to FIG. 4 showing the surface locations of four rows of wells referred to with reference numerals 41, 42, 43 and 44. Row 41 comprises two pair of wells, each pair comprises an injection well 46 and 49, respectively and a production well 48 and 53 respectively. Row 42 comprises two pair of wells, each pair comprises an injection well 55 and 57, respectively and a production well 56 and 59 respectively. Row 43 comprises two pair of wells, each pair comprises an injection well 61 and 65, respectively and a production well 62 and 66 respectively. Row 44 comprises two pair of wells, each pair comprises an injection well 67 and 70, respectively and a production well 69 and 72 respectively. The injection wells terminate in the reservoir (not shown) and the production wells terminate in the reservoir below the injection wells.

Row 42 of wells faces row 41 of wells, and row 42 is a second row of wells with respect to row 41. Row 43, facing now 42, is a first row of wells with respect to row 42, and row 44 is a second row of wells with respect to row 43.

During normal operation permeable zones are created between the injection wells and the production wells, which comprises circulating steam through the injection wells and performing alternate steam injection and fluid production through the production wells.

Thereafter steam is injected through the injection wells, wherein the injection pressure of injection wells pertaining to the first rows 41 and 43 of wells is greater than the injection pressure of the injection wells of the second rows 42 and 44 of wells.

Suitably the difference in injection pressure between adjacent injection wells is between 50 and 2000 kPa.

Suitably the injection well and the production well of a pair of wells have a horizontal end part (not shown) which is located in the reservoir. The horizontal end parts can be parallel to each other and the horizontal end part of production well extends in a direction similar to the direction of the horizontal end part of the injection well. Suitably the wells in a row of wells are so arranged that the directions of the horizontal end parts of the wells substantially coincide with the direction of the row.

The wells have been completed with a horizontal end part, and the part of the casing in the horizontal end part open to the reservoir by perforations or other means. At least part of the opened casing can be replaced by a liner arranged in the horizontal section of the borehole.

The wells can also be completed with more than one tubing, for example a dual tubing completion so that injection is done through one tubing and production through the other tubing instead of through the annular space surrounding the tubing.

We claim:

1. A method of recovering fluids from an underground tar sand reservoir or heavy oil reservoir comprising the steps of: (a) drilling and completing a first pair and a second pair of wells, wherein each pair of wells comprises an injection well terminating in the reservoir and a production well terminating in the reservoir below the injection well; (b) creating for each pair of wells a permeable zone between the injection well and the production well; and (c) injecting steam through the injection wells while producing fluid through the production wells, wherein the injection pressure of the injection well of the first pair of wells is greater than the injection pressure of the injection well of the second pair of wells.

2. The method of claim 1, wherein creating the permeable zone between the injection well and the production well in step (b) comprises circulating steam through the injection wells and performing alternate steam injection and hydrocarbon production through at least one of the production wells.

3. The method of claim 1, wherein in step (c) the difference in injection pressure between adjacent injection wells is between 50 and 2 000 kPa.

4. The method of claim 1, wherein the injection well and the production well of a pair of wells have a horizontal end part which is located in the reservoir.

5. The method of claim 4, wherein the horizontal end parts are parallel to each other.

6. The method of claim 4, wherein the horizontal end part of production well extends in the direction of the horizontal end part of the injection well.

7. The method of claim 4, wherein the horizontal end part of production well extends in the direction of the horizontal end part of the injection well.

8. The method of claim 1, wherein at least two rows of wells are drilled, each row comprises one or more pair(s) of wells, wherein each pair comprises an injection well terminating in the reservoir and a production well terminating in the reservoir below the injection well, wherein the second row of wells faces the first row of wells, wherein, after creating a permeable zone between the injection wells and the corresponding production wells of each row, steam is injected through the injection wells, and wherein the injection pressure of injection wells pertaining to the first row of wells is greater than the injection pressure of the injection wells of the second row of wells.

9. The method of claim 8, wherein creating the permeable zone between the injection well and the production well comprises circulating steam through the injection wells and performing alternate steam injection and fluid production through the production wells.

10. The method of claim 8, wherein the difference in injection pressure between adjacent injection wells is between 50 and 2 000 kPa.

* * * * *